US007566108B2

(12) United States Patent
Nojima et al.

(10) Patent No.: US 7,566,108 B2
(45) Date of Patent: Jul. 28, 2009

(54) RECORDING APPARATUS WITH DETECTION OF IMPROPERLY MOUNTED HEAD CARTRIDGES

(75) Inventors: Takashi Nojima, Tokyo (JP); Takeshi Sekino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 11/476,127

(22) Filed: Jun. 28, 2006

(65) Prior Publication Data

US 2007/0008366 A1 Jan. 11, 2007

(30) Foreign Application Priority Data

Jul. 4, 2005 (JP) ..... 2005-194976

(51) Int. Cl.
*B41J 29/393* (2006.01)
*B41J 2/14* (2006.01)

(52) U.S. Cl. ..... 347/19; 347/50

(58) Field of Classification Search ..... 347/37, 347/19, 7, 23, 49, 35, 86, 87, 9, 50
See application file for complete search history.

(56) References Cited

U.S. PATENT DOCUMENTS

| | | | | |
|---|---|---|---|---|
| 5,638,097 | A * | 6/1997 | Takayanagi et al. | 347/7 |
| 6,137,503 | A * | 10/2000 | Hashimoto et al. | 347/19 |
| 6,338,539 | B1 * | 1/2002 | Kobayashi et al. | 347/23 |
| 6,471,334 | B2 * | 10/2002 | Kline et al. | 347/49 |
| 6,511,153 | B1 * | 1/2003 | Ishikawa | 347/35 |
| 6,530,634 | B1 * | 3/2003 | Hara | 347/7 |
| 6,779,874 | B2 * | 8/2004 | Sturgeon et al. | 347/49 |
| 7,380,904 | B2 * | 6/2008 | O'Hara et al. | 347/37 |
| 2005/0179756 | A1 * | 8/2005 | Hatasa et al. | 347/86 |
| 2006/0244796 | A1 * | 11/2006 | Sekino et al. | 347/87 |
| 2007/0002087 | A1 * | 1/2007 | Matsui et al. | 347/9 |
| 2007/0008366 | A1 | 1/2007 | Nojima et al. | 347/19 |

FOREIGN PATENT DOCUMENTS

| | | |
|---|---|---|
| GB | 2334236 A | 8/1999 |
| JP | 2002-234179 | 8/2002 |
| JP | 2002-254670 | 9/2002 |
| JP | 2003-19817 | 1/2003 |
| RU | 2234420 C2 | 8/2004 |

OTHER PUBLICATIONS

Notice of Allowance/Search Report, issued by the Russian Patent Office, on Sep. 12, 2007, in Russian Application No. 2006123536/12(025544).
Official Letter dated Mar. 11, 2009, in corresponding Vietnamese Patent Application No. 1-2006-01062.
Office Action dated Dec. 5, 2008 in corresponding Chinese Patent Application No. 2006100985263.

* cited by examiner

*Primary Examiner*—Stephen D Meier
*Assistant Examiner*—Carlos A Martinez, Jr.
(74) *Attorney, Agent, or Firm*—Fitzpatrick, Cella, Harper & Scinto

(57) ABSTRACT

A recording apparatus for effecting recording using a head cartridge includes a carriage to which the head cartridge is mountable, the carriage being movable while carrying the head cartridge; an encoder for detecting movement of the carriage; a detecting portion for detecting whether or not the carriage and the head cartridge are electrically connected with each other; and a discriminating section for discriminating that the head cartridge is not properly mounted to the carriage, when the encoder, after an operation of mounting the head cartridge to the carriage, does not detect the movement of the carriage, and the detecting portion, after the operation of mounting the head cartridge to the carriage, does not detect electrical connection between the carriage and the head cartridge.

12 Claims, 15 Drawing Sheets

RECORDING APPARATUS WITH DETECTION OF IMPROPERLY MOUNTED HEAD CARTRIDGES

FIELD OF THE INVENTION AND RELATED ART

The present invention relates to a recording apparatus. More specifically, it relates to a recording apparatus comprising a carriage, on which a recording head is removably mountable and which is moved to record an image on recording medium.

A recording apparatus having the function of a printer, a copying machine, a facsimile machine, or the like, and a recording apparatus employed as the output device for a multi-functional electronic device (inclusive of a computer), a word-processor, etc., or the output device for a work-station, are structured to record an image or the like on various recording medium such as paper, fabric, plastic sheet, OHP sheet, etc., based on image formation information.

Recording apparatuses can be classified based on the type of recording means, for example, the ink jet type, wire dot type, thermal type, laser beam type, etc.

Further, recording apparatuses can be classified based on the movement of recording means, for example, the serial type and line type. A recording apparatus of the serial type records an image by moving its recording head in a manner to scan recording medium in the primary direction, that is, the direction perpendicular to the recording medium conveyance direction. Further, a recording apparatus of the serial type records an image with the use of a recording means mounted on or in its recording medium carriage which moves across recording medium. More specifically, it moves recording paper by a preset distance each time a portion of an image, which corresponds to a single scanning movement of the recording means in the direction perpendicular to the recording medium conveyance direction, is completed. Then, it records the next portion of an image, which also corresponds to a single scanning movement of the recording means in the direction perpendicular to the recording medium conveyance direction. Then, the recording paper is moved again by the preset distance. These steps are repeated to scan the entirety of the recording paper to complete an intended image.

In comparison, a recording apparatus of the line type records an image by moving its recording medium only in the secondary direction, that is, the direction parallel to the recording medium conveyance direction. More specifically, in the case of a recording apparatus of the line type, recording medium is set in the preset recording start position. Then, the portion of an image, which corresponds to the first line of text, is recorded all at once, and the recording paper is moved by the preset distance. Then, the portion of the image, which corresponds to the second line of text, is recorded all at once. These steps are repeated to record the entirety of the intended image.

Among the recording apparatuses of the above described types, an ink jet recording apparatus is a recording apparatus that records an image by ejecting ink onto recording medium from its recording means. The recording means for an ink jet recording apparatus enjoys the following advantages. That is, it is easy to reduce in size, and is capable of recording a highly precise image at a high speed. Further, it can record on ordinary paper; it does not require ordinary paper to be given a special treatment. Further, it is lower in running cost. It is of the non-impact type, being therefore lower in noise level. Moreover, it can be easily adapted for recording a color image with the use of multiple inks different in color.

An ink jet recording apparatus employs a non-contact recording method, being therefore capable of recording on various types of recording medium. Thus, an ink jet recording apparatus can be classified according to the physical properties of the recording medium usable therewith, for example, the size of recording medium, the shape of recording medium, etc. In other words, an ink jet recording apparatus can be classified according to the type of recording medium usable therewith. For example, an ink jet recording apparatus can be classified as an ink jet recording apparatus usable with ordinary paper as well as recording medium dedicated to an ink jet recording apparatus (recording paper capable of absorbing ink), an ink jet recording apparatus dedicated to recording on an envelope or postcard of a specific size, or an ink jet recording apparatus dedicated to recording on a compact disk.

A recording head employed by an ink jet recording apparatus such as the one described above is provided with multiple ejection orifices for ejecting droplets of ink (which hereafter may be referred to as ink droplet). When the recording head is in operation, ink droplets are ejected from the ejection orifices in response to ejection signals generated based on recording data. As a result, an image is printed on recording medium.

Some recording apparatuses of the serial type are structured so that their recording heads are removably mountable on or in their reciprocating recording head carriages.

Japanese Laid open Patent Application 2002-234179 discloses the following structural arrangement for an ink jet recording apparatus of the serial type. That is, before moving a print cartridge into a specific cartridge position in the carriage by operating a head setting lever, the needle retaining member is moved by moving the needle moving lever, the ink needle comes into contact with the erroneous operation prevention rib located near the print cartridge and above the connective member. As a result, a user is informed that both levers were erroneously operated.

Japanese Laid open Patent Application 2002-254670 discloses an ink jet recording apparatus, the cartridge holder of the carriage of which comprises: a cover which can be rotatably opened or closed; a mechanism which is moved by the closing movement of the cover to move an ink cartridge into the ink cartridge position in the carriage; and a rib as an erroneous mount preventing means for preventing an ink cartridge from being moved further onto the cartridge carriage if the ink cartridge is abnormally positioned relative to the carriage at the beginning of the mounting of the ink cartridge, that is, if the ink cartridge fails to be properly engaged with the carriage at the beginning of the mounting of the ink cartridge.

However, ink jet recording apparatuses in accordance with the prior art are structured to use the state of a lever or the like to inform a user of the erroneous mounting of an ink jet cartridge. Therefore, they are problematic in that they do not enable a user to easily see the state of an ink jet cartridge, making it likely for the erroneous mounting to be overlooked. They are also problematic in that unless the lever or the like for mounting an ink jet head is provided with a sensor dedicated to the detection of the erroneous mounting of an ink jet head, a recording apparatus cannot detect the erroneous mounting, being therefore incapable of displaying an error message.

SUMMARY OF THE INVENTION

It is a principal object of the present invention to provide a recording apparatus wherein the improper mounting of the recording head to the carriage can be detected without use of a sensor exclusively therefor and without use of a complicated mechanism.

According to an aspect of the present invention, there is provided a recording apparatus for effecting recording using a head cartridge, comprising a carriage to which the head cartridge is mountable, said carriage being movable while carrying the head cartridge; first detecting means for detecting movement of said carriage; second detecting means for detecting whether or not said carriage and the head cartridge are electrically connected with each other; and discriminating means for discriminating that the head cartridge is not properly mounted to said carriage, when said first detecting means, after an operation of mounting the head cartridge to said carriage, does not detect the movement of said carriage, and said second detecting means, after the operation of mounting the head cartridge to said carriage, does not detect electrical connection between said carriage and the head cartridge, either.

According to another aspect of the present invention, there is provided a recording apparatus for effecting recording using a head cartridge, comprising a carriage to which the head cartridge is mountable, said carriage being movable while carrying the head cartridge; first detecting means for detecting movement of said carriage; and second detecting means for detecting whether or not said carriage and the head cartridge are electrically connected with each other, wherein when said second detecting means, after an operation of mounting the head cartridge to said carriage, does not detect electrical connection between said carriage and the head cartridge, the carriage is moved at a speed lower than when said second detecting means detects the electrical connection therebetween.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
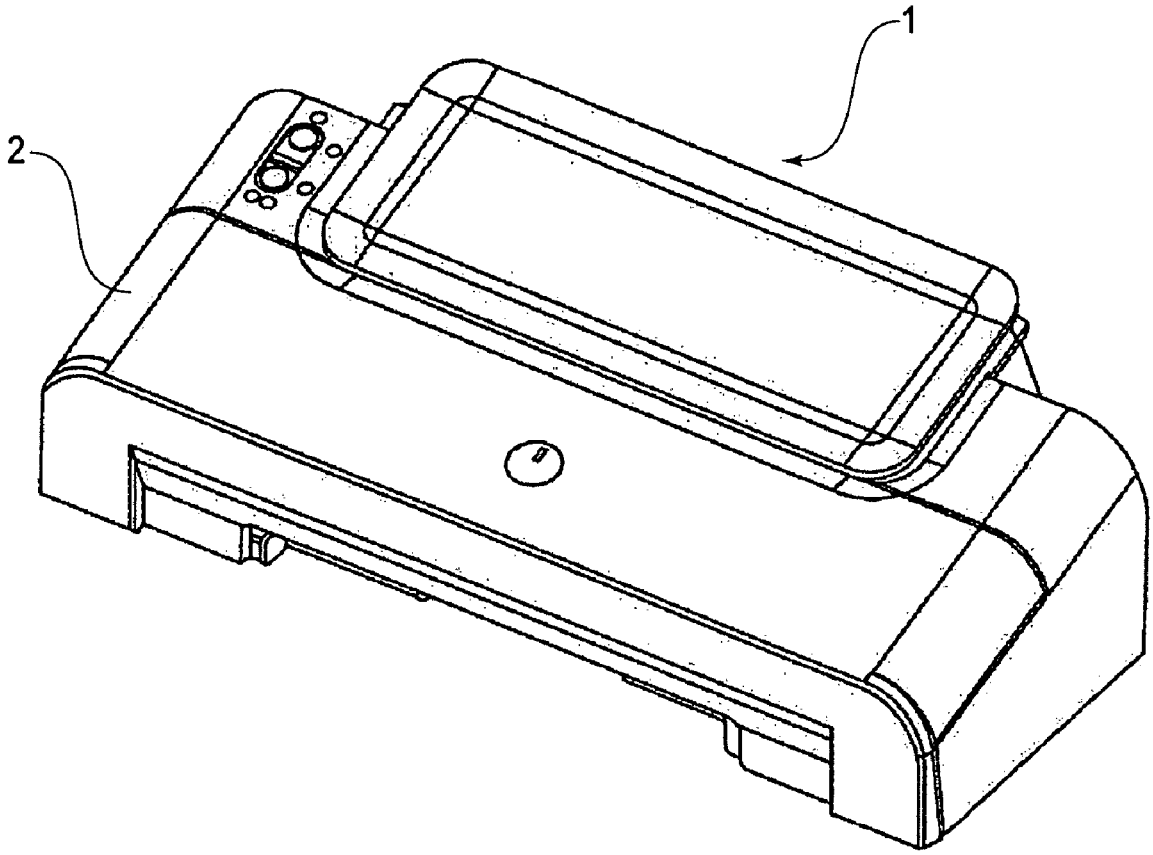
FIG. 1 is an external perspective view of the recording apparatus in the preferred embodiment of the present invention.
Figure 2:
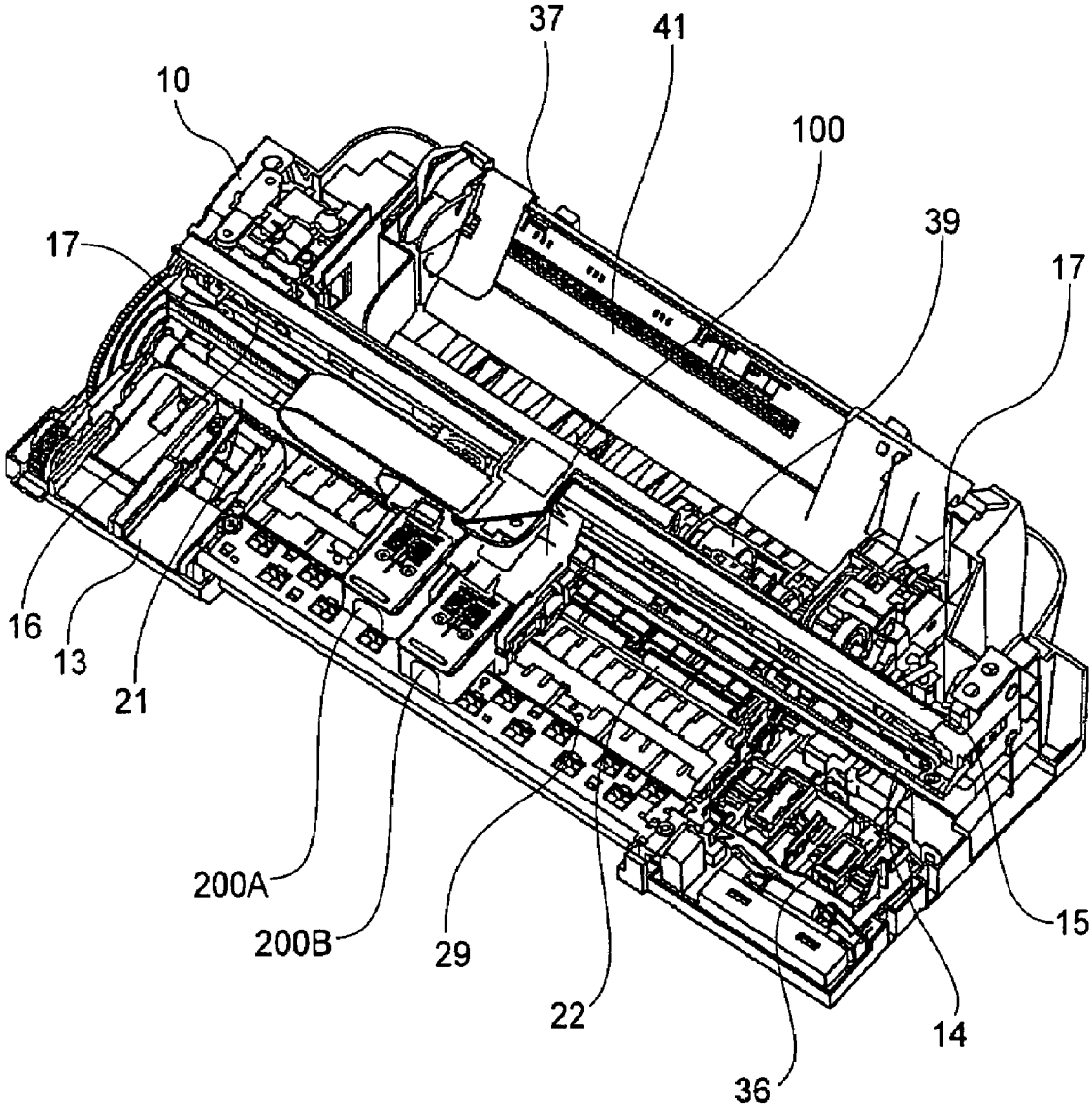
FIG. 2 is a perspective view of the recording apparatus, in the preferred embodiment of the present invention, the housing of which has been removed, showing the internal structure thereof.

FIG. 1 is an external perspective view of the recording apparatus in the first preferred embodiment of the present invention. FIG. 2 is a perspective view of the recording apparatus according to the first preferred embodiment of the present invention, in which the housing thereof has been removed to show the internal structure thereof. The recording apparatus in this embodiment is an ink jet recording apparatus, that is, a recording apparatus which records on recording medium by ejecting ink.

The recording apparatus in this embodiment comprises a recording medium feeding portion 37, a recording medium conveying portion, a carriage portion, and a maintenance portion 36. Recording data are sent from an unshown host apparatus, and are stored in a control portion of a storage portion of a control circuit of the apparatus. A recording operation begins as a recording command is issued from the control portion.

As the recording operation starts, the recording medium feeding operation is first carried out; a sheet of recording medium is fed to the recording medium conveying portion. More specifically, as the recording medium feeding operation is started, an ASF motor is rotated in the forward direction, and the driving force from the ASF motor is transmitted through a gear train to a cam, thereby rotating the cam, which is in contact with a pressure application plate 41. As a result, the cam becomes disengaged from the pressure application plate 41, allowing the pressure application plate 41 to move toward a feed roller 39 by the pressure from plate springs. As the feed roller 39 is rotated in the direction to feed recording medium, only the topmost of the sheets of recording medium stacked on the pressure application plate 41 is fed into the main assembly of the recording apparatus. Incidentally, however, it sometimes happens that two or more sheets are fed into the main assembly at the same time because of the deviation in the amount of friction between the feed roller 39 and recording medium, the amount of friction between adjacent two sheets of recording medium, and the like factors.

The recording medium feeding portion 37 is provided with a separation roller, which is kept pressed against the feed roller 39. The separation roller is provided with a preset amount of torque, which is large enough to move a sheet of recording medium in the direction opposite to the normal sheet conveyance direction, and functions to return the sheets of recording medium other than the one which is in contact with the fed roller 39, toward the pressure application plate 41. As the recording medium feeding operation ends, the force which keeps the separation roller pressed against the feed roller 39 is removed by the movement of the above-mentioned cam. Then, a return pawl is rotated in the direction opposite to the sheet conveyance direction, returning the sheets of recording medium other than the one in contact with the feed roller 39 toward the pressure application plate 41. Therefore, only a single sheet of recording medium is fed to the recording medium conveying portion.

After being conveyed to the recording medium conveying portion, the sheet of recording medium is conveyed to the nip between a sheet conveyance roller 21 and a pinch roller 22, which are not being rotated. The pinch roller 22 is disposed so that its rotational axis is offset in the downstream direction relative to the rotational axis of the conveyance roller 21, with respect to the sheet conveyance direction. Therefore, after the sheet of recording medium passes the nip between the conveyance roller 21 and pinch roller 22, it is pressed upon a platen.

As the sheet of recording medium is brought into contact to the nip formed between the conveyance roller 21 and the pinch roller 22, which are not being rotated, the sheet of recording medium is made to bow between the feed roller 39 and conveyance roller 21. By this bowing of the sheet of recording medium, the resiliency of the sheet of recording medium presses the leading edge of the sheet of recording medium to the nip. As a result, the leading edge of the sheet of recording medium becomes parallel to the conveyance roller 21, thus effecting registration of the sheet of recording medium. After the registration of the sheet of recording medium, the rotations of the feed roller 39 and conveyance roller 21 are started so that the leading end portion of the sheet pops. Thereafter, the transmission of the driving force to the feed roller 39 is interrupted, allowing thereby the feed roller 39 to be rotated by the movement of the sheet of recording medium. Then, the sheet of recording medium is conveyed downstream by only the conveyance roller 21 and pinch roller 22, while being guided by ribs with which a platen 29 is provided.

Then, the sheet of recording medium is conveyed by first and second sheet discharge rollers disposed on the downstream side of a recording means 200, and first and second spur like wheels which are in contact with the first and second sheet discharge rollers, respectively. The peripheral velocities of the first and second sheet discharge rollers are set to be roughly equal to the peripheral velocity of the conveyance roller 21. The force for driving the first and second sheet discharge rollers is transmitted thereto from the conveyance roller 21 through gears or the like, ensuring that the sheet of recording medium is conveyed without being slackened or excessively tensioned.

The recording portion is constituted by the recording means 200 and a carriage 100 on which the recording means 200 is mounted. The carriage 100 is enabled to move in the direction intersectional to the recording medium conveyance direction while carrying the recording means 200. The carriage 100 is supported by a guide rail 14 and a support rail 15. The guide rail 14 is supported by a chassis 10 of the apparatus. The support rail 15 is a part of the chassis 10. The carriage 100 is moved in a reciprocating manner by the driving force transmitted from a carriage motor 17 through a carriage belt 16 stretched between the carriage motor 17 and an idler pulley 20.

To the recording means 200, signals are transmitted from a head driver of the electric circuit through a flexible flat cable 73. The recording means 200 is capable of ejecting ink droplets in response to these signals. A code strip 18 is attached to the chassis 10, being stretched roughly in parallel to the guide rail 14. An encoder mounted in the carriage 100 reads the code strip 18, making it possible for ink droplets to be ejected onto the recording medium with proper timing. Each time a portion of an image, which corresponds to a single line of text, is completely recorded, the recording medium is conveyed a necessary distance by the recording medium conveying portion. These steps are repeated to records across the entirety of the recording medium surface.

The recording means 200 contains multiple ink passages, each of which is in fluid communication with an associated ink ejection outlet which opens at the surface of the recording means 200 which faces the platen 29. On the inward side of each of the aligned multiple ejection outlets, an actuator (energy generation element) for ejecting ink is disposed. As the actuator, an electrothermal transducer (heat generation element), which utilizes the pressure generated by liquid (ink) as liquid is heated to the film boiling point, an electromechanical transducer (electro-pressure transducer), such as a piezoelectric element, or the like can be used.

In this embodiment, a head cartridge includes the recording means and an ink storage portion (ink container), which are integrated with each other, is employed. The carriage 100 is provided with two cartridge slots, being therefore enabled to carry two head cartridges. When recording a normal color image, a black head cartridge 200A, and a color head cartridge 200B which includes cyan, magenta and yellow cartridges, are used. Instead of the black head cartridge 200A, an optional photo head cartridge which includes black, light cyan and light magenta ink cartridges may be used with the color head cartridge 200B to record in the photographic tone. Further, in order to use the recording apparatus as a scanner, the black head cartridge 200A or color head cartridge 200B may be replaced with a scanner head as an optional head. The head cartridges 200A and 200B, the optional photo head cartridge, and the optional scanner cartridge are roughly the same in shape and size.

Figure 3:
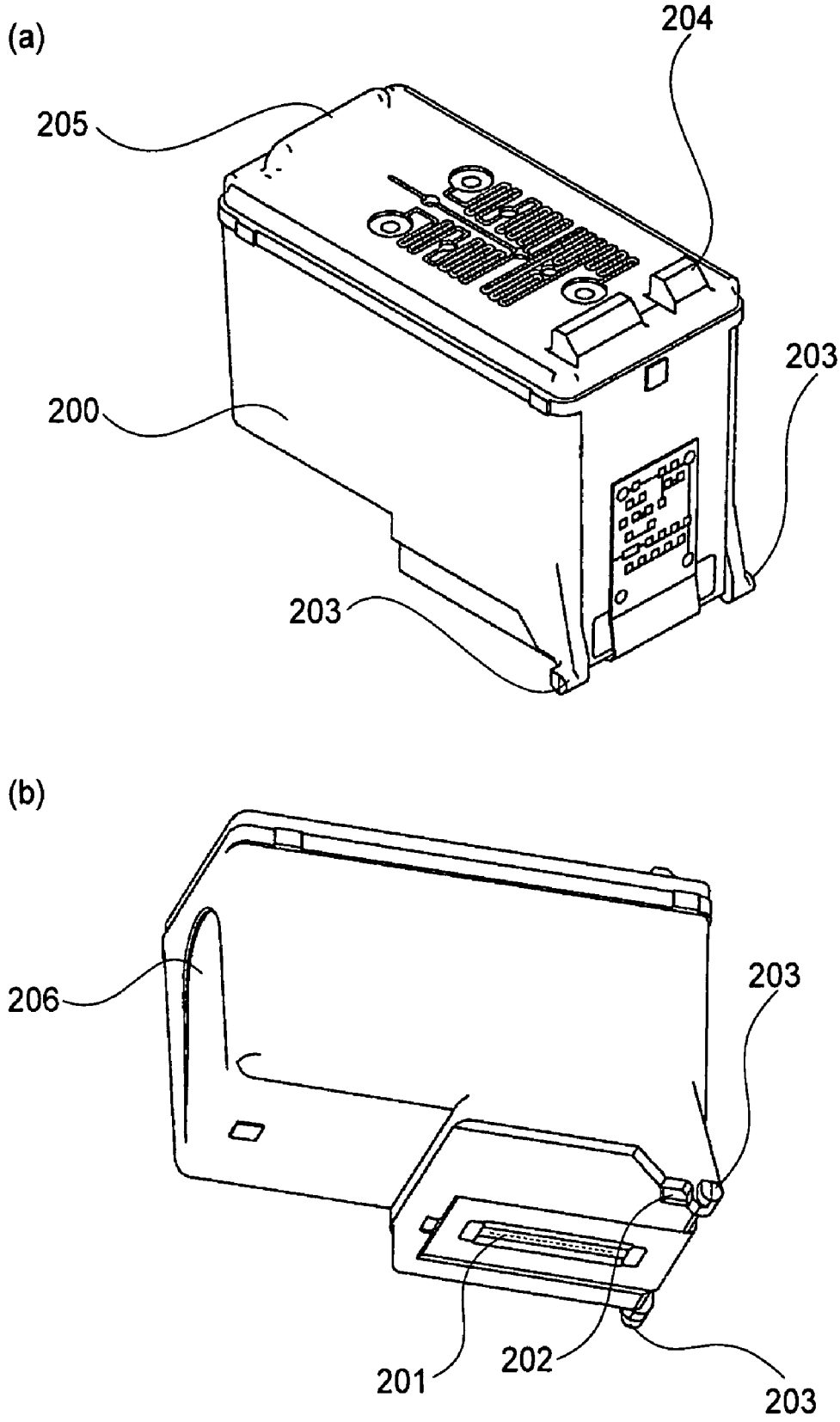
FIG. 3 is a perspective view of the head cartridge in the preferred embodiment of the present invention.

FIG. 3 is a perspective view of the typically shaped black head cartridge 200A in this embodiment. The main body of the head cartridge 200A is provided with a pair of cartridge positioning grooves 202, which are located at the bottoms of the lateral surfaces of the cartridge, one for one. The main body is also provided with a pair of projections 203 for roughly guiding a head cartridge 200 (which hereafter will be referred to as rough guide projections), which project from the portions of the lateral surfaces of the main body, which are on the contact surface side of the main body.

Figure 4:
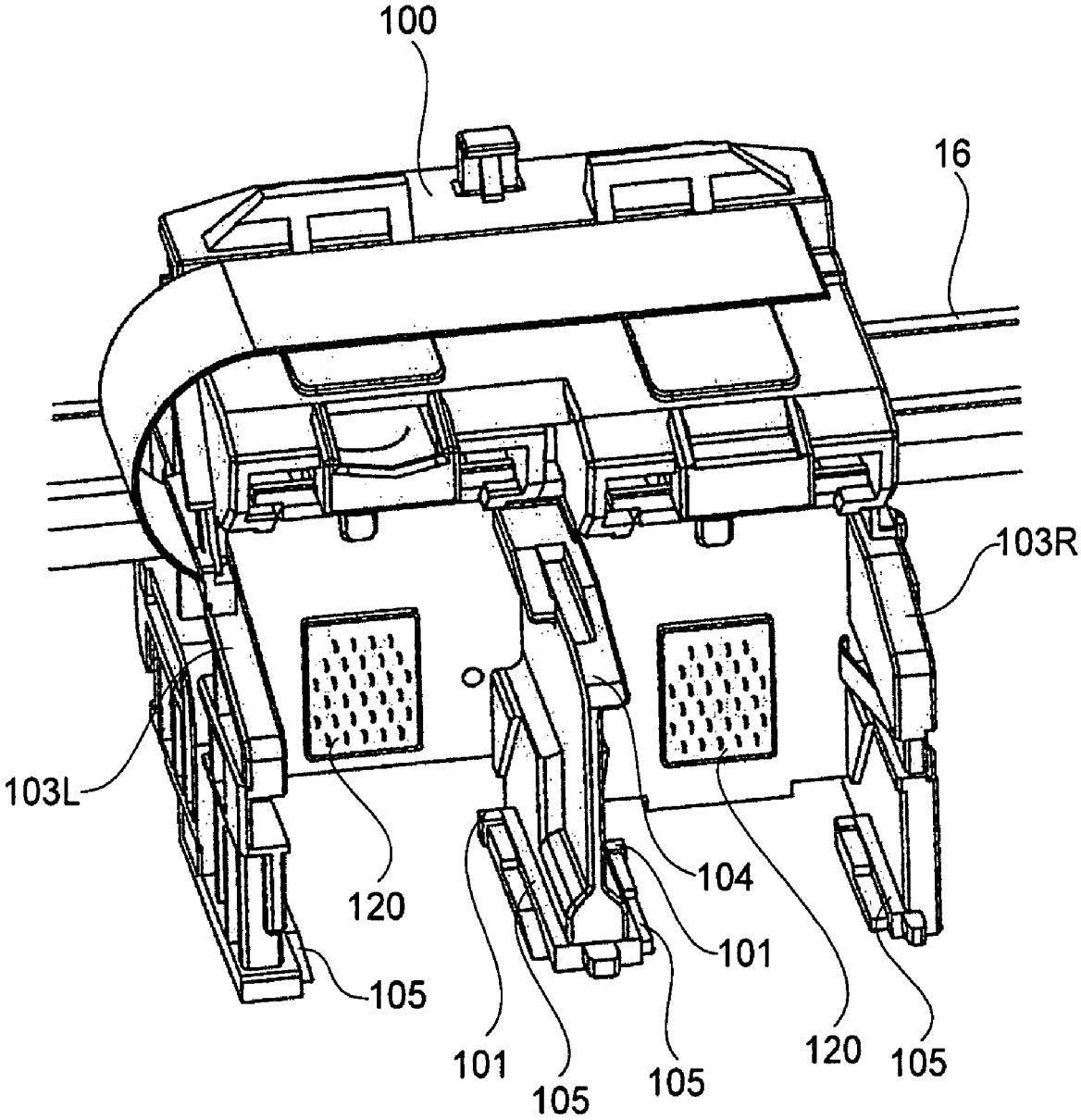
FIG. 4 is a perspective view of the carriage in the preferred embodiment of the present invention.
Figure 5:
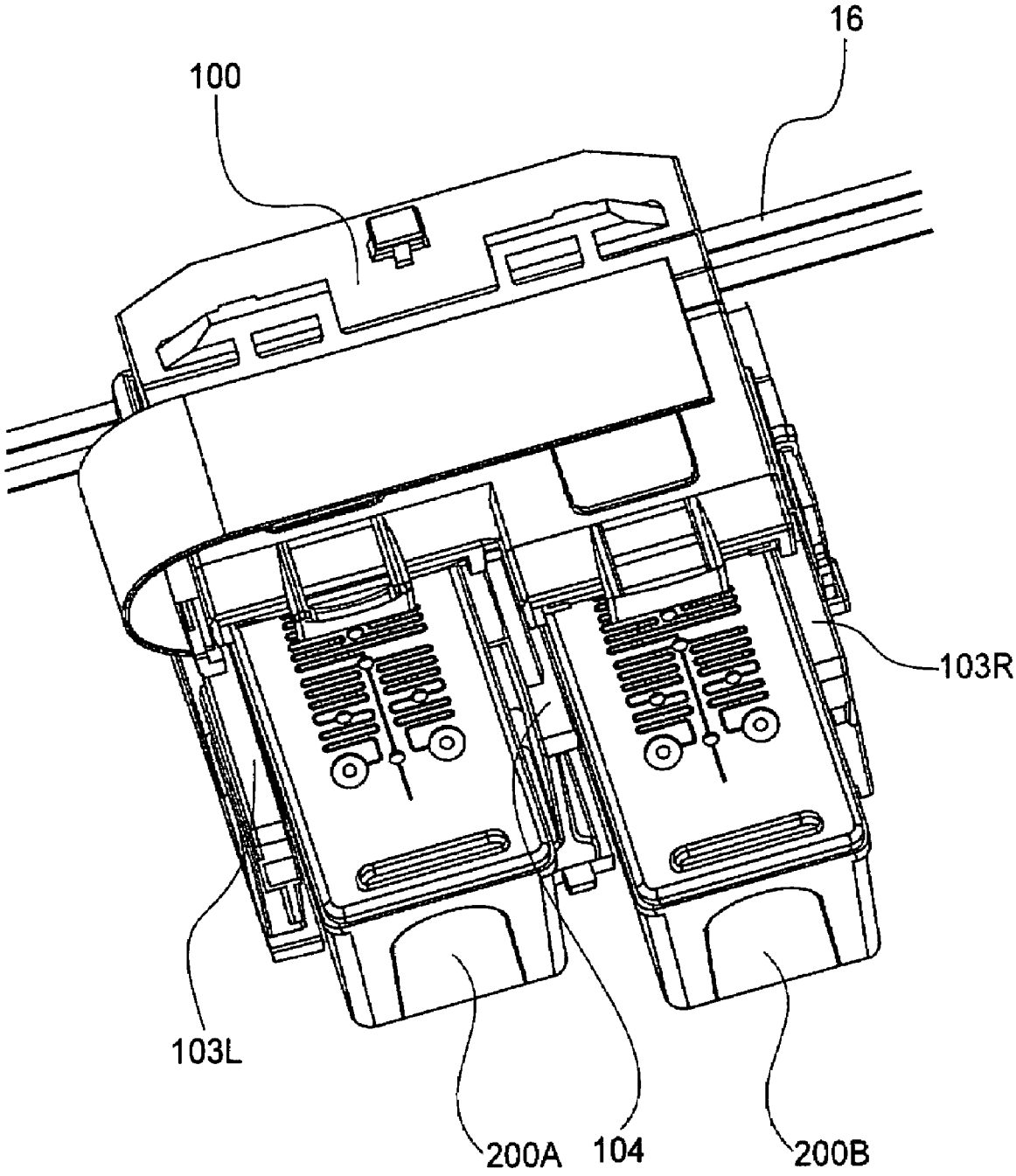
FIG. 5 is a perspective view of the carriage, and the head cartridge in the proper position in the carriage.

FIG. 4 is a perspective view of the carriage 100 in this embodiment of the present invention. FIG. 5 is a perspective view of the carriage 100, on which the black head cartridge 200A and color head cartridge 200B have just been mounted. The carriage 100 has lateral walls 103 and a center wall 104. The space between the left lateral wall 103L and center wall 104, and the space between the right lateral wall 103R and center wall 104, serve as the slots for the head cartridges 200. The bottom ends of the left and right lateral walls and the bottom end of the center wall are rendered thick. The thick bottom portion of each of the left and right lateral walls is provided with a positioning projection 101 which fits in the positioning groove 202 of the head cartridge 200, and a guiding groove 105 for guiding the rough guide projection 203 of the head cartridge when the head cartridge 200 is mounted or dismounted, whereas the thick bottom portion of the center wall is provided with a pair of positioning projections 101 and a pair of guiding grooves 105. Moreover, the carriage 100 is provided with a connector 120 and a headset cam 110. The connector 120 is contactable with the circuit board of the head cartridge 200 to establish electrical connection between the carriage 100 and head cartridge 200. The headset cam 110 is spring loaded to keep the head cartridge 200 firmly held to the carriage 100.

Figure 6:
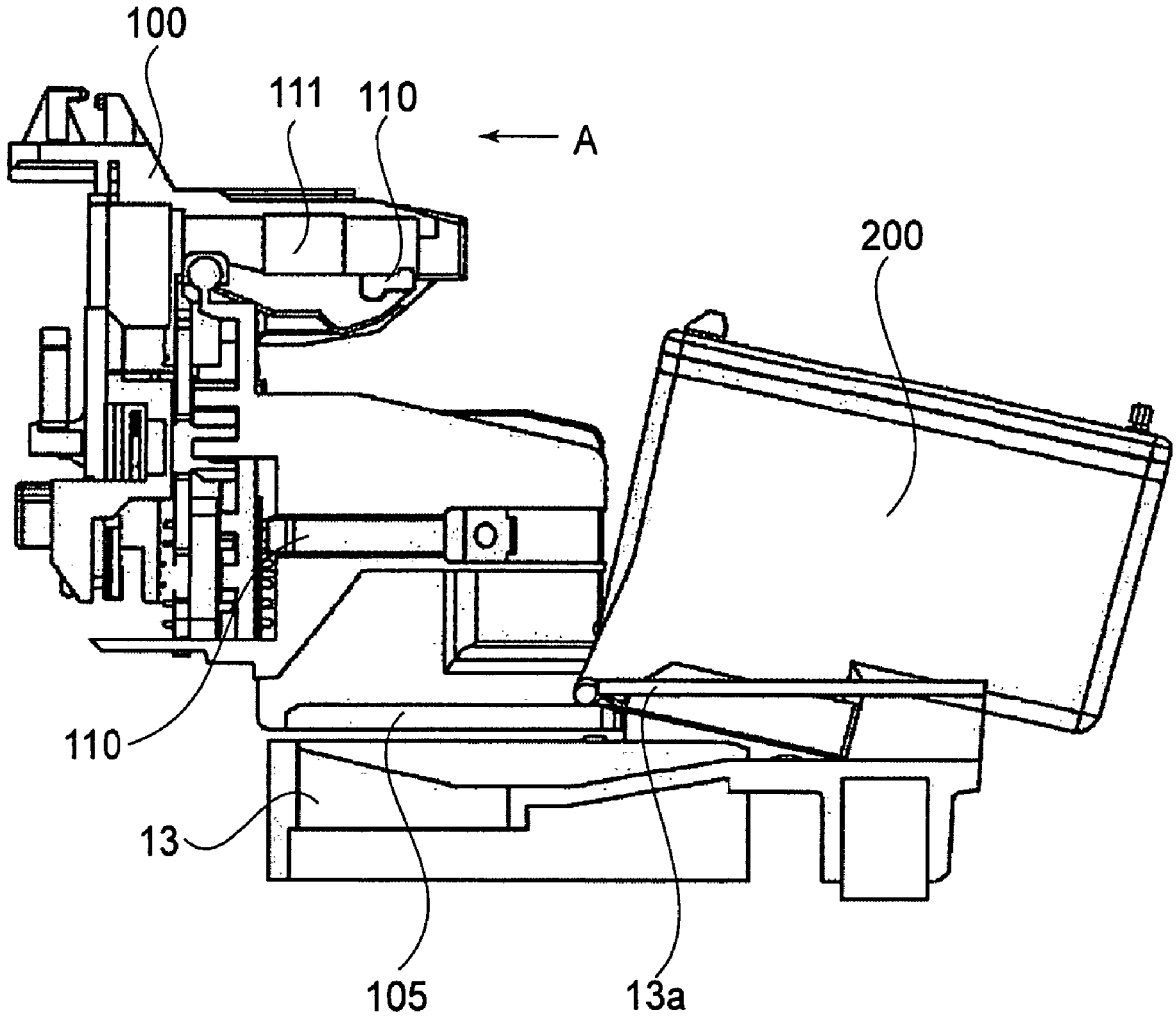
FIG. 6 is a sectional view of the carriage, and the head cartridge in its initial position in which it is placed when it is mounted into the carriage.
Figure 7:
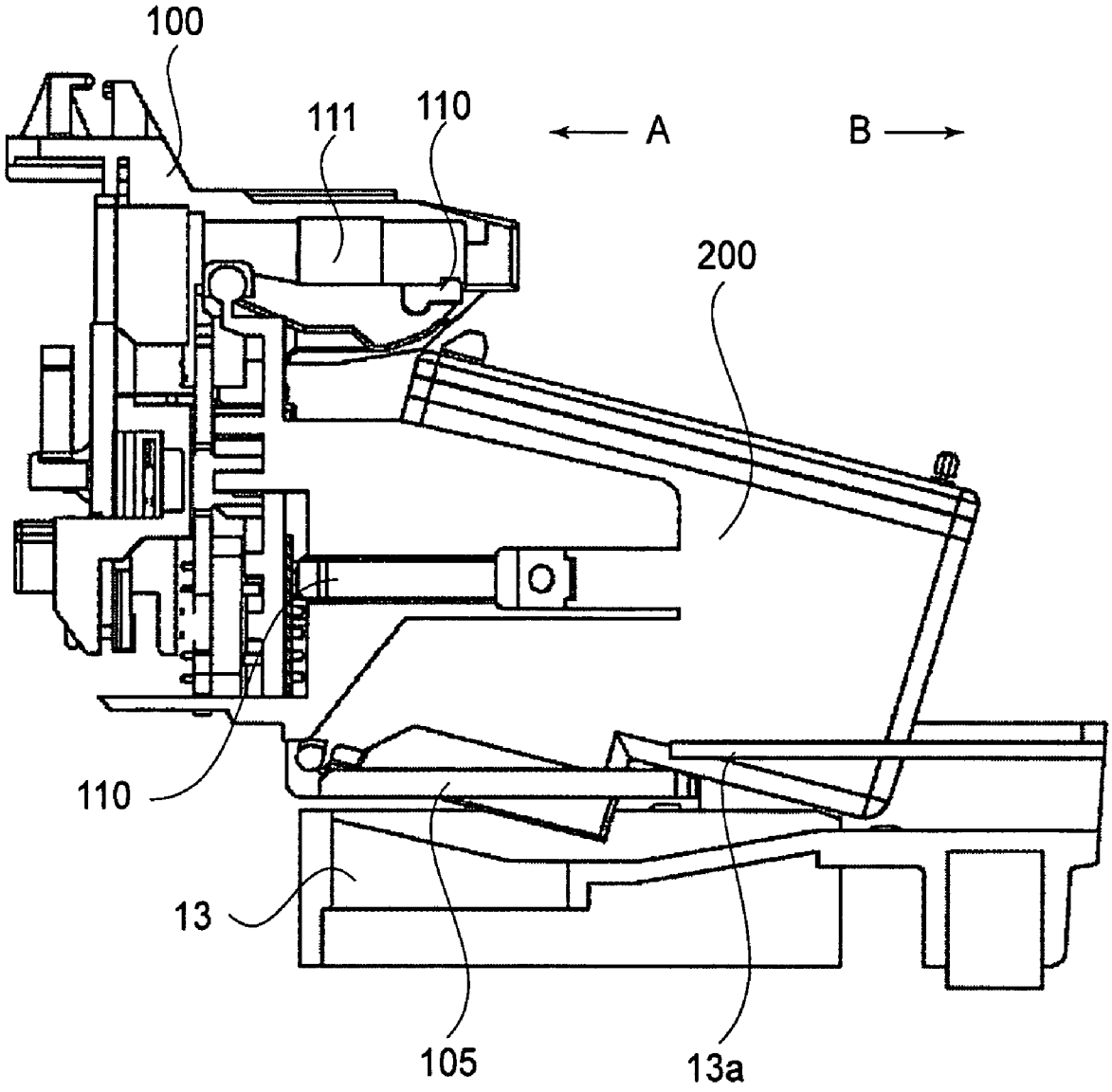
FIG. 7 is a perspective view of the carriage, and the head cartridge which is being mounted into the carriage.
Figure 8:
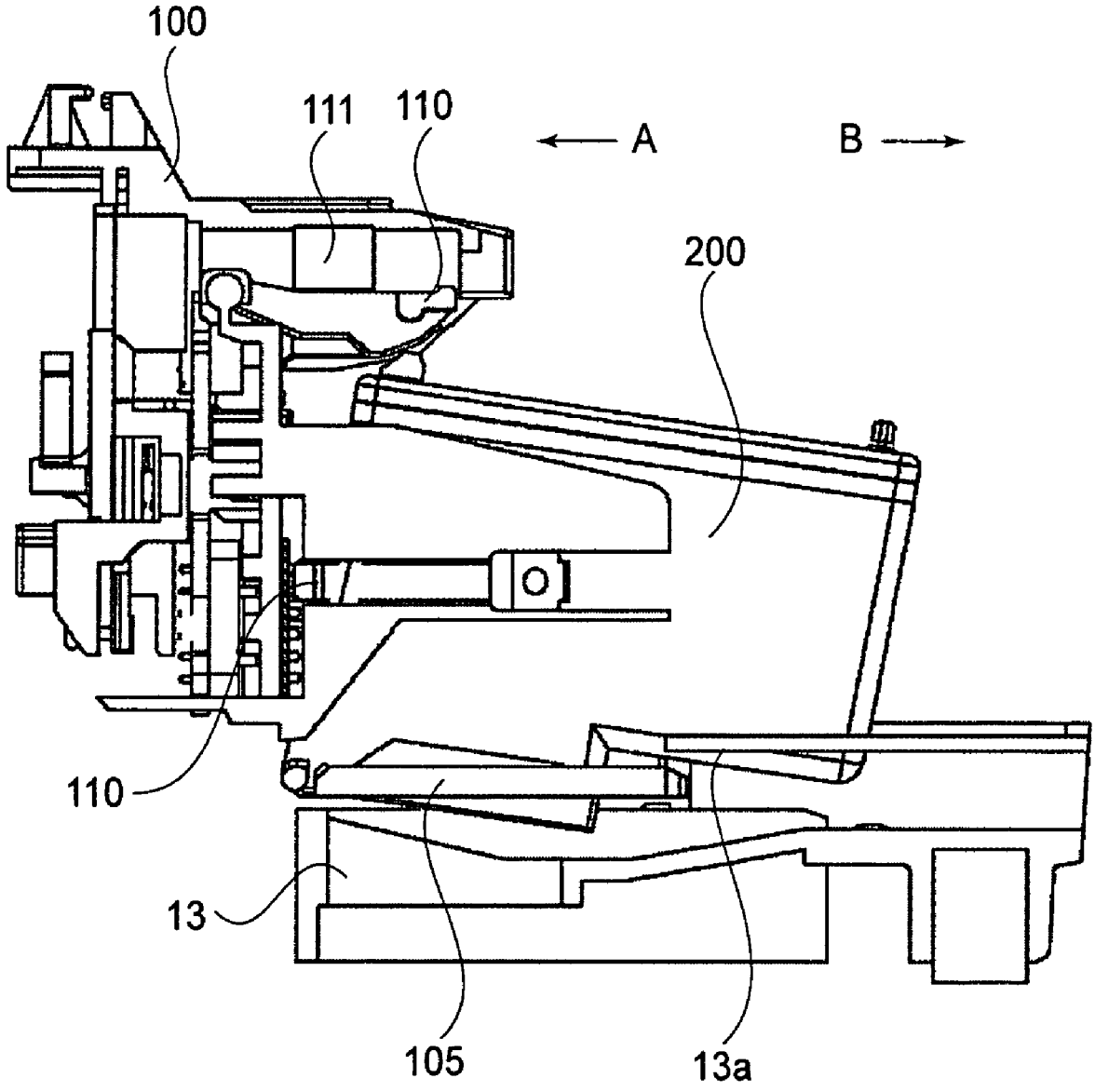
FIG. 8 is a perspective view of the carriage, and the head cartridge which is being mounted into the carriage.
Figure 9:
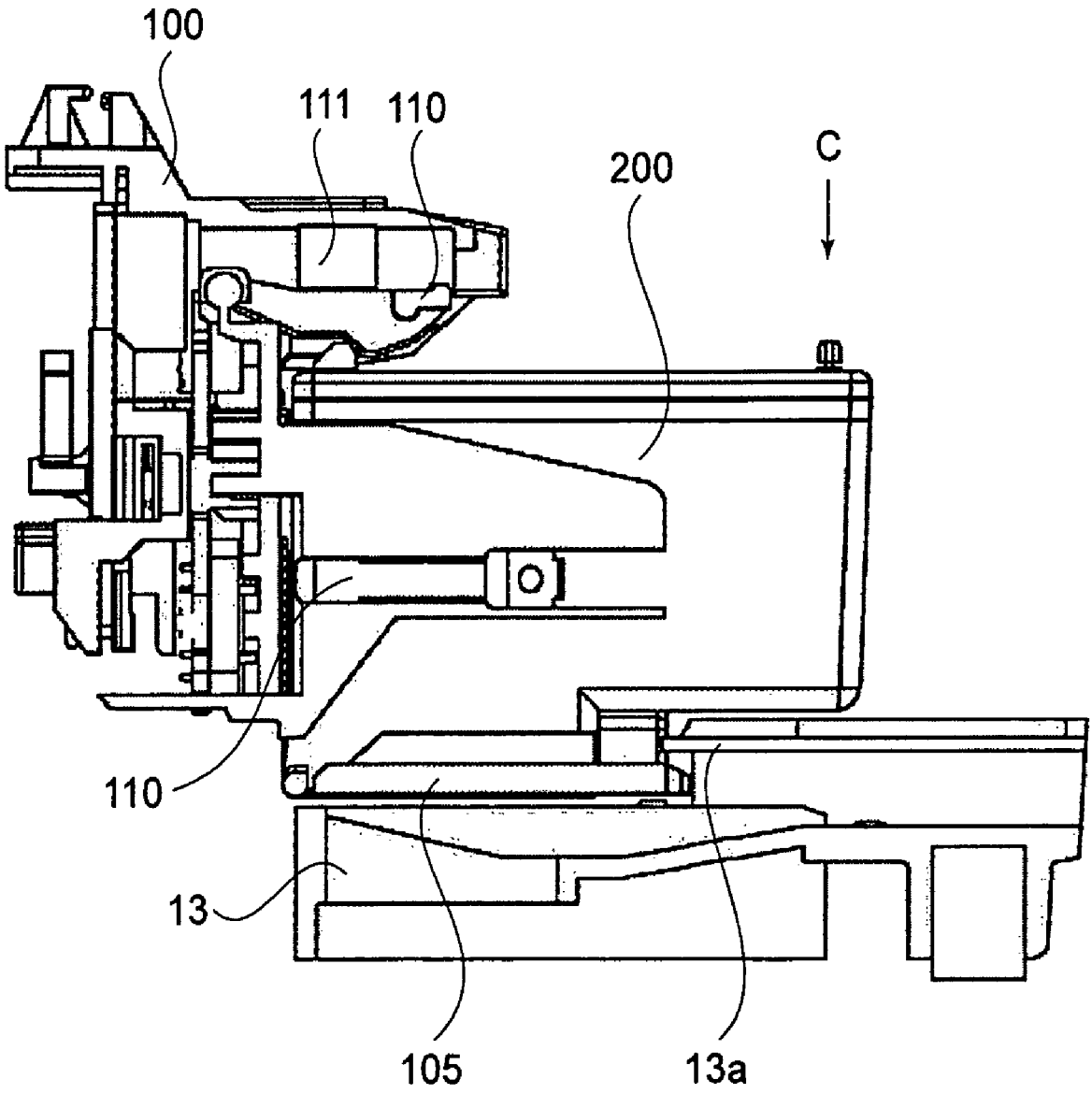
FIG. 9 is a perspective view of the carriage, and the head cartridge which has just been completely mounted into the carriage.
Figure 10:
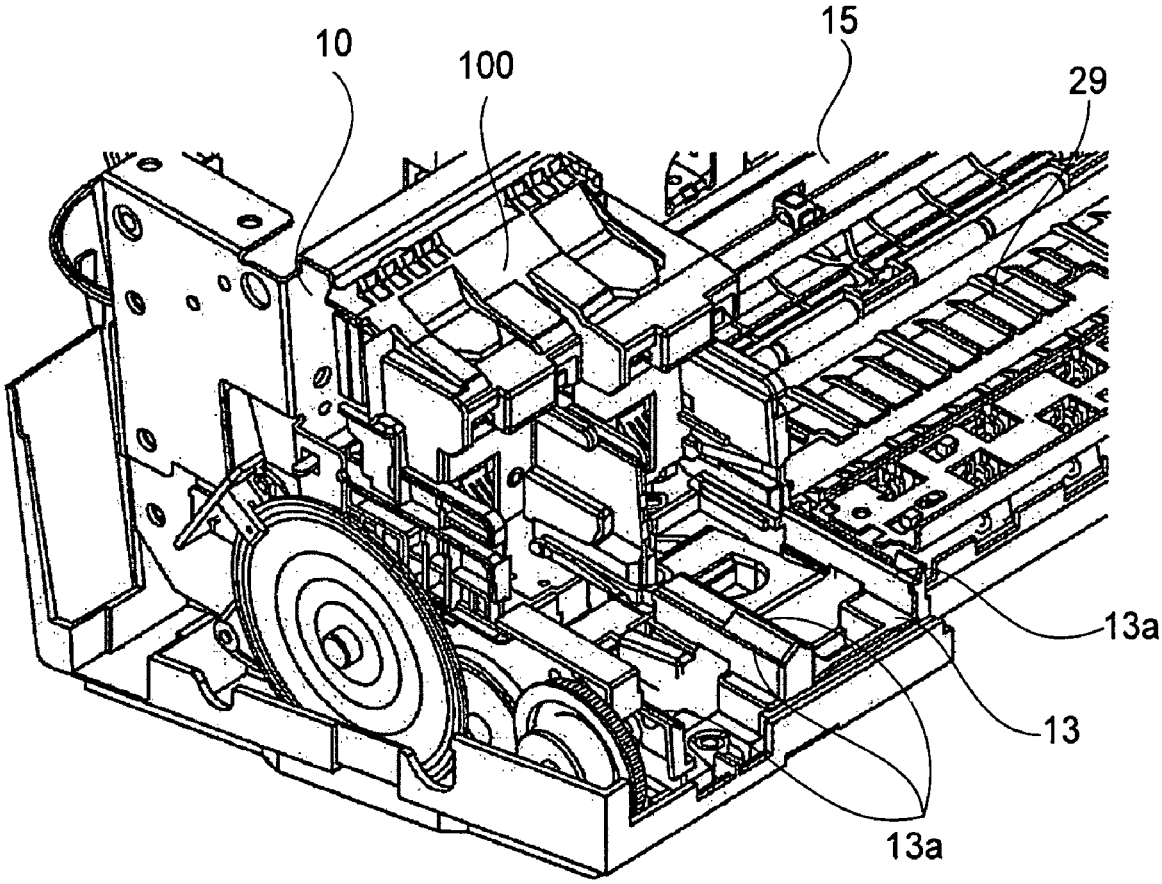
FIG. 10 is a perspective view of the carriage and head cartridge guiding member, in the preferred embodiment of the present invention.

The operation for mounting the head cartridge 200 into the carriage 100 and the operation for removing the head cartridge 200 from the carriage 100 will be described. FIG. 6 is a sectional view of the carriage 100, and the head cartridge 200 which has just begun to be mounted into the carriage 100. FIGS. 7 and 8 are sectional views of the carriage 100, and the head cartridge 200 which is being mounted into the carriage 100. FIG. 9 is a sectional view of the carriage 100, and the head cartridge 200 which has just been properly mounted into the carriage 100. FIG. 10 is a perspective view of the carriage 100 and a head guiding member 13, in this embodiment of the present invention.

The head cartridge 200 is to be mounted into the carriage 100 in the following manner. First, a user is to insert the rough guide projections 203 into the guiding grooves 13*a* of the head guiding member 13 of the recording apparatus main assembly, one for one. With the rough guide projections 203 fitted in the guiding grooves 13*a*, the head cartridge 200 is guided in the direction indicated by an arrow mark A while remaining in a preset attitude. The carriage 100 is provided with the guiding grooves 105, which are located at a lower level, in terms of the gravity direction, than the guiding grooves 13*a* of the head guiding member 13. Therefore, it does not occur that the rough guide projections 203 hang up while the head cartridge 200 is being mounted into the carriage 100; it does not occur that the operation for mounting the head cartridge 200 is interrupted. While the head cartridge 200 is mounted into the carriage 100, the rear end portion of the head cartridge 200, in terms of the cartridge mounting direction, remains in contact with the head guiding member 13. Therefore, even if the user moves his or her hand away from the head cartridge 200 during the mounting of the head cartridge 200, the attitude of the head cartridge 200 does not change. As the head cartridge 200 is moved further in the direction of the arrow mark A, the head pressing portion 204 on the top surface of the head cartridge 200 comes into contact with the headset cam 110 of the carriage 100, which is shaped as shown in FIG. 7. Therefore, the rough guide projection 203 continues to move in the direction of the arrow mark A while the head cartridge 200 is rotated in the clockwise direction.

Referring to FIG. 8, as the head cartridge 200 is further pushed into the carriage 100 in the direction of the arrow mark A, the head pressing portion 204 is moved downward by the headset cam 110, and the rough guide projections 203 are guided downward by the guiding grooves 105. The movement of the head cartridge 200 in the width direction of the head cartridge 200 is regulated by the two lateral walls 103 and center wall 104 of the carriage 100. Therefore, it does not occur that the rough guide projections 203 disengage from the guiding grooves 105.

As the head cartridge 200, which is in the state shown in FIG. 8, is further pushed into the carriage 100 in the direction of the arrow mark A, the headset cam 110 is placed in contact with the head pressing portion 204, by the resiliency of the headset spring 111, and is made to draw the head cartridge 200 into the carriage 100 by the resiliency of the headset spring 111. As the head cartridge 200 is drawn into the carriage 100 as far as it can be, while being rotated, the positioning grooves of the head cartridge 200 meet the pressure bearing portions of the positioning projections 101 of the carriage 100, and the pressure bearing portion of the top portion of the head cartridge 200 comes into contact with the pressure applying portion of the carriage 100. As a result, the head cartridge 200 is properly positioned relative to the carriage 100, as shown in FIG. 9. At the same time as the completion of the placement of the head cartridge 200 in the state shown in FIG. 9, the electrical connection is established between the head cartridge 200 and the connector 120 of the carriage 100. Thus, the detection can be made as to whether or not the head cartridge 200 is in the proper position in the recording apparatus by detecting the state of electrical connection between the head cartridge 200 and the connector 120 of the carriage 100.

Referring to FIG. 9, when the head cartridge 200 is in the proper position in the carriage 100, the rough guide projections 203 are outside the guiding grooves 105, and therefore, it does not interfere with the process of properly positioning the head cartridge relative to the carriage 100.

As for the operation for removing the head cartridge 200 from the carriage 100, all that is necessary is to carry out in reverse the operation for mounting the head cartridge 200 into the carriage 100.

More specifically, referring to FIG. 9, first, the head cartridge 200 is to be pushed down, that is, in the direction indicated by an arrow mark C. As the head cartridge 200 is pushed down, it is released from the headset cam 110, being thereby placed in the state shown in FIG. 8. Then, the head cartridge 200 in the state shown in FIG. 8 is to be pulled out, that is, to be pulled in the direction of arrow mark B with the use of a non-slip finger placement rib 205 of the carriage 100. As the head cartridge 200 is pulled in the direction of an arrow mark B, the head cartridge 200 rotates in the counterclockwise direction about the positioning grooves 202 of the head cartridge 200 and the positioning projections of the carriage 100. As a result, the rough guide projections 203 are guided to where they fit into the guiding grooves 105 of the carriage 100.

As the head cartridge 200 is pulled out further in the direction of the arrow mark B, the rough guide projections 203 are moved, following the guiding grooves 105 of the carriage 100, to the front side (side from which recording medium is discharged) of the main assembly of the recording apparatus. As the rough guide projections 203 are moved to the front ends of the guiding grooves 105 of the carriage 100, they comes into contact with the guiding grooves 13*a* of the head guiding member 13 which is located at a higher level, in terms of the gravity direction, than the level at which the guiding grooves 105 of the carriage 100 are located. At the same time, the head cartridge 200 tends rotate about the rough guide projections 203. However, as the head cartridge 200 is pulled out further, its trailing portion, in terms of the head cartridge insertion direction, comes into contact with the head guiding member 13 as it was when the head cartridge 200 was mounted into the carriage 100. Therefore, it does not occur that the head cartridge 200 falls off from the carriage 100.

Figure 11:
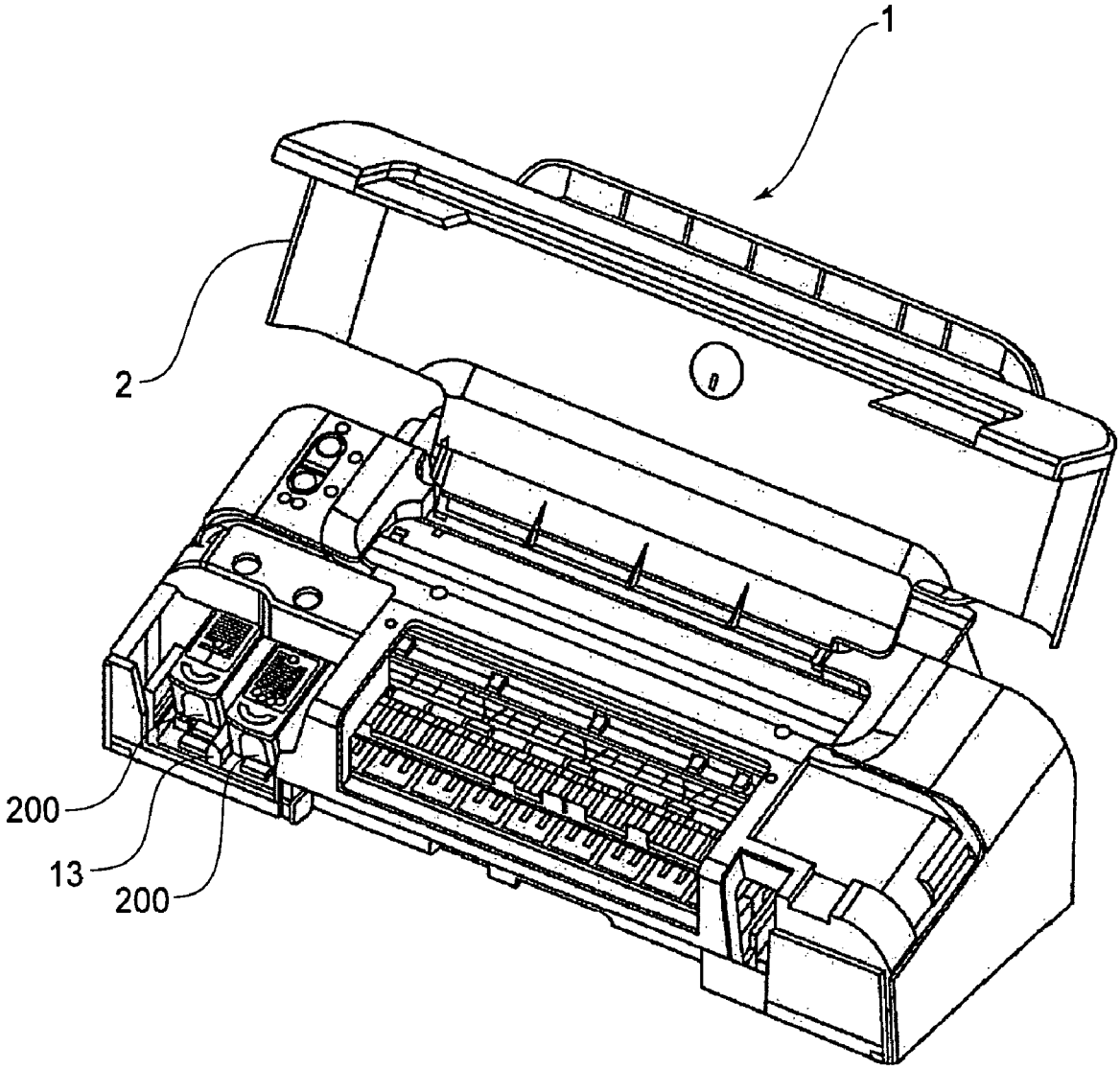
FIG. 11 is a perspective view of the recording apparatus in the preferred embodiment of the present invention, showing the operation for replacing the head cartridge.

FIG. 11 is a perspective view of the recording apparatus in this embodiment, depicting the movements of the various components of the recording apparatus, which occur when the head cartridge 200 is replaced. In FIG. 11, designated by a reference numeral 2 is an access cover, which is rotatable relative to the main assembly 1 of the recording apparatus to expose the front side of the interior of the main assembly 1 of the recording apparatus. Whether the access cover 2 is in the open or closed state is detected by an unshown sensor. As it is detected that the access cover 2 is open, the carriage 100 is moved by the driving of the carriage motor to the position in which the carriage 100 opposes the guiding member 13. It is when the carriage 100 is in this position that the user can replace the head cartridge 200. On the other hand, as it is detected that the access cover 2 is in the closed state, the carriage 100 is moved rightward by the driving of the carriage motor to its stand-by position.

If the access cover 2 happens to be closed before the head cartridge 200 is completely mounted into the carriage 100, the head cartridge 200 is still in contact with the head guiding member 13, preventing thereby the carriage 100 from moving. More specifically, the erroneous mounting of the head cartridge 200 can be detected by the head guiding member 13, which is the member for guiding the head cartridge 200 when the head cartridge 200 is mounted into the carriage 100. Therefore, the erroneous mounting of the head cartridge 200 can be detected quickly, that is, before the carriage 100 is hardly moved. Therefore, it is possible to prevent the problem that the components of the recording apparatus and the head cartridge 200 are damaged because the carriage 100 is moved with the head cartridge 200 erroneously mounted in the carriage 100.

Figure 12:
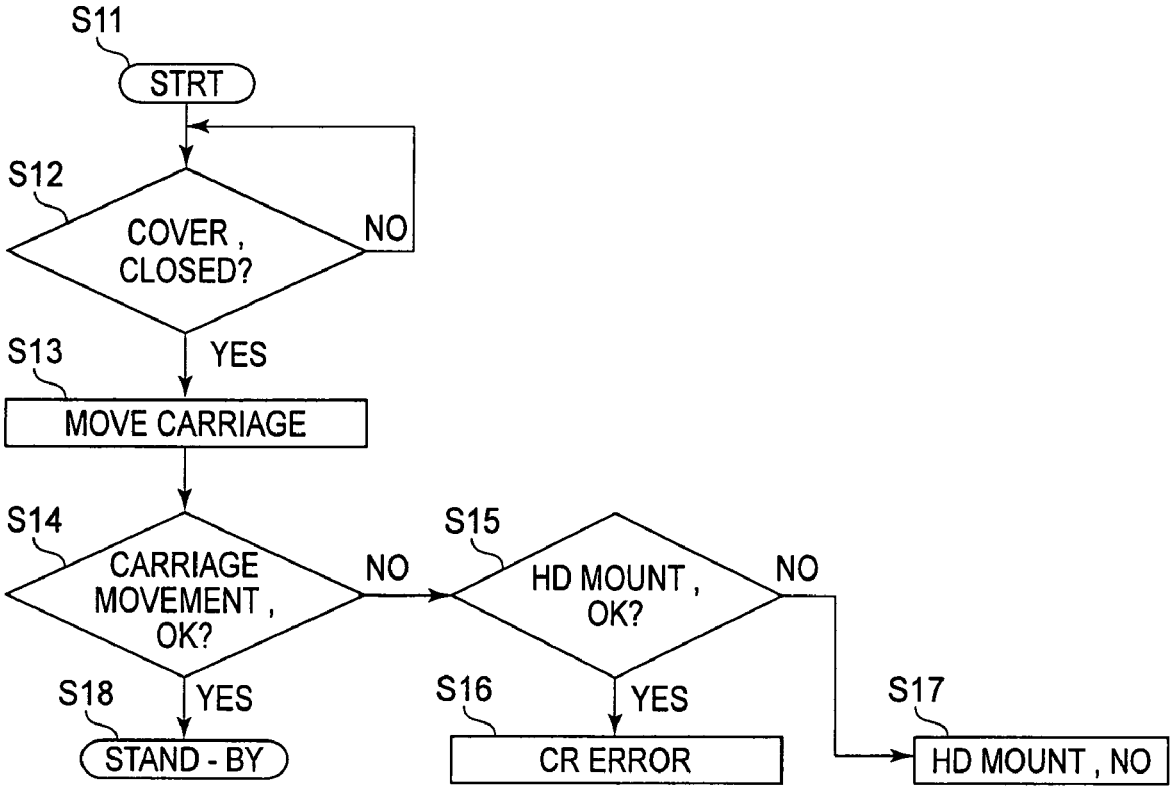
FIG. 12 is a flowchart of the operation of the recording apparatus in the first preferred embodiment of the present invention.

Referring to FIG. 12, the operational sequence of the recording apparatus which occurs after the proper mounting of the head cartridge 200 will be described. FIG. 12 is a flowchart of the operational sequence of the recording medium in this embodiment.

Referring to FIG. 12, the operational sequence starts at step S13, and the state of the access cover 2 is detected in step S12. If it is detected that the access cover 2 is not in the closed state (if decision is N), the operation for detecting the state of the access cover 2 is repeated. If it is detected that the access cover 2 is in the closed state (decision is Y), moving of the carriage 100 is started (S13). Then, it is detected in step S14, based on the signals from the encoder, whether or not the carriage 100 is normally moving. If it is detected in step S14 that the carriage 100 is normally moving (decision is Y), the carriage 100 is moved to its stand-by location, and the recording apparatus is put on stand-by (S18). If it is detected in step S14 that the carriage 100 is not normally moving (decision is N), step S15 is taken, in which the state of the head cartridge 200, in terms of the positioning of the head cartridge 200 relative to the carriage 100, is detected. The state of the head cartridge 200 in terms of the positioning of the head cartridge 200 relative to the carriage 100 is detected by detecting the state of the electrical connection between the head cartridge 200 and the connector 120 of the carriage 100. If it is detected in step S15 that the head cartridge 200 is in the carriage 100 (decision is Y), it is determined that the carriage 100 is not movable because of foreign matters such as the recording medium having jammed in the carriage track, and a CR error message is issued (S16). If it is detected in step S15 that the head cartridge 200 is not in the carriage 100 (decision is N), it is determined that the head cartridge 200 is in contact with the head guiding member 13, preventing thereby the carriage 100 from moving; it is determined that the mounting of the head cartridge 200 is incomplete, that is, the head cartridge 200 has not been correctly mounted (S17). As it is determined that the head cartridge 200 has not been correctly mounted, that is, the head cartridge 200 has been erroneously mounted, a message describing this situation is displayed on a displaying means 511 of the recording medium main assembly 1. Instead, a command for displaying a message stating that the head cartridge 200 has not been correctly mounted may be sent to the host computer through an interface 506.

Figure 13:
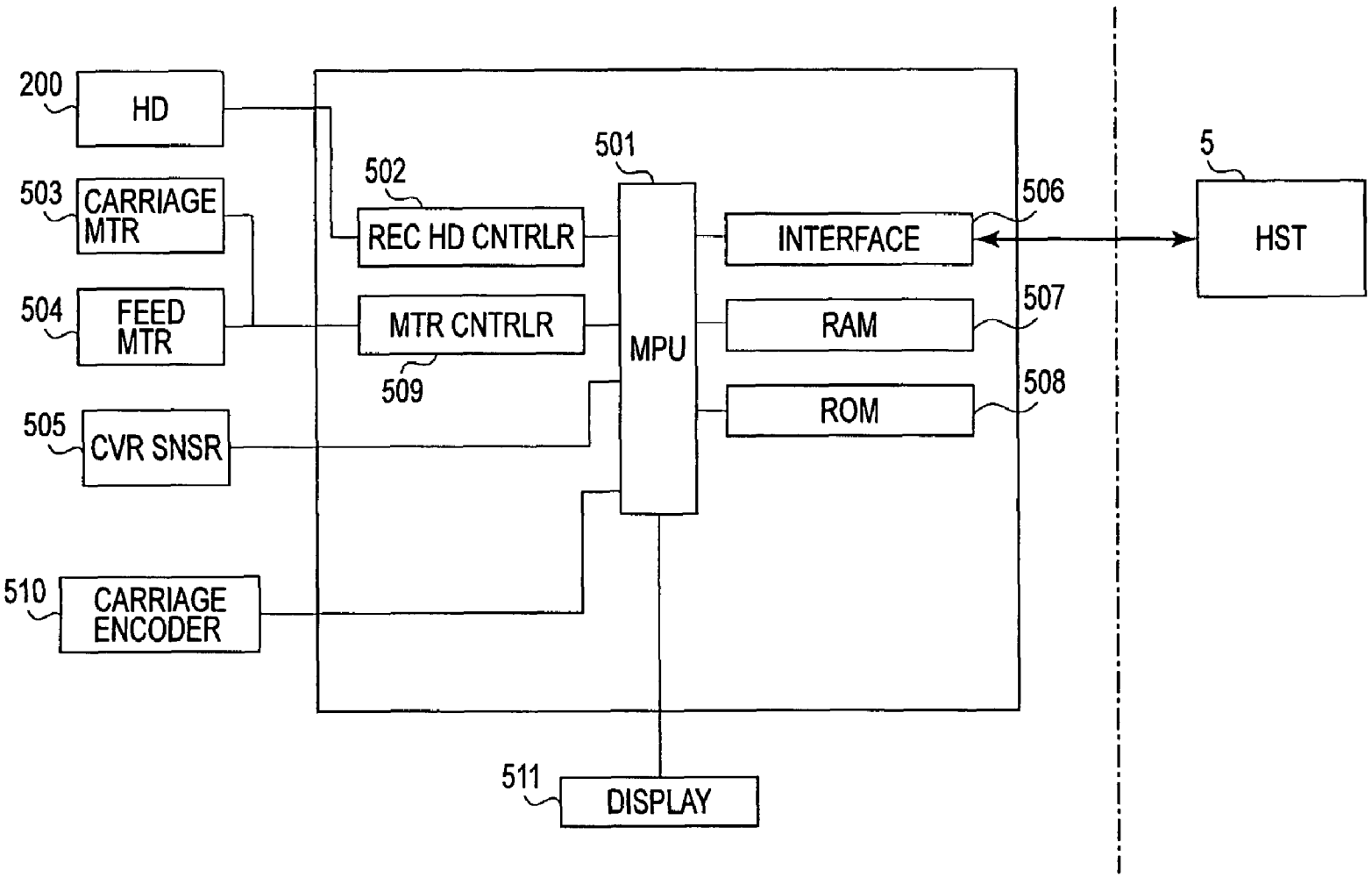
FIG. 13 is a block diagram of the electrical control of the recording apparatus in the first preferred embodiment.

FIG. 13 is a block diagram of the electrical control of the recording apparatus in this embodiment. In FIG. 13, designated by a reference numeral 501 is a MPU which controls the entirety of the recording apparatus. The head cartridge 200 is connected to the MPU 501 through a recording head controller 502. The carriage motor 503 and sheet feed motor 504 are connected to the MPU 501 through a motor controller 509. Further, the access cover sensor 505 and carriage encoder 510 are connected to the MPU 501. Also, a RAM 507, a ROM 508 in which control programs and the like are stored, are connected to the MPU 501. The host computer 5 is connected to the MPU 501 through the interface 506. Designated by a reference numeral 511 is displaying means, which has an LED or liquid crystal display, or the like for displaying an error message.

The carriage 100 of the recording apparatus in this embodiment is capable of holding multiple head cartridges 200. Further, it is capable of carrying out a recording operation even when it is holding only a single head cartridge 200. In the case of a recording apparatus such as the one in this embodiment, simply detecting that all the head cartridges 200 are not in the carriage 100 does not verify that a head cartridge mounting error has occurred.

Sometimes, a user thinks that a head cartridge has been properly mounted, even though it has been incompletely mounted. This embodiment makes it possible to warn the user of such a situation, that is, the head cartridge has been incompletely mounted. In other words, this embodiment makes it possible to prompt the user to remount the head cartridge.

Embodiment 2

Figure 14:
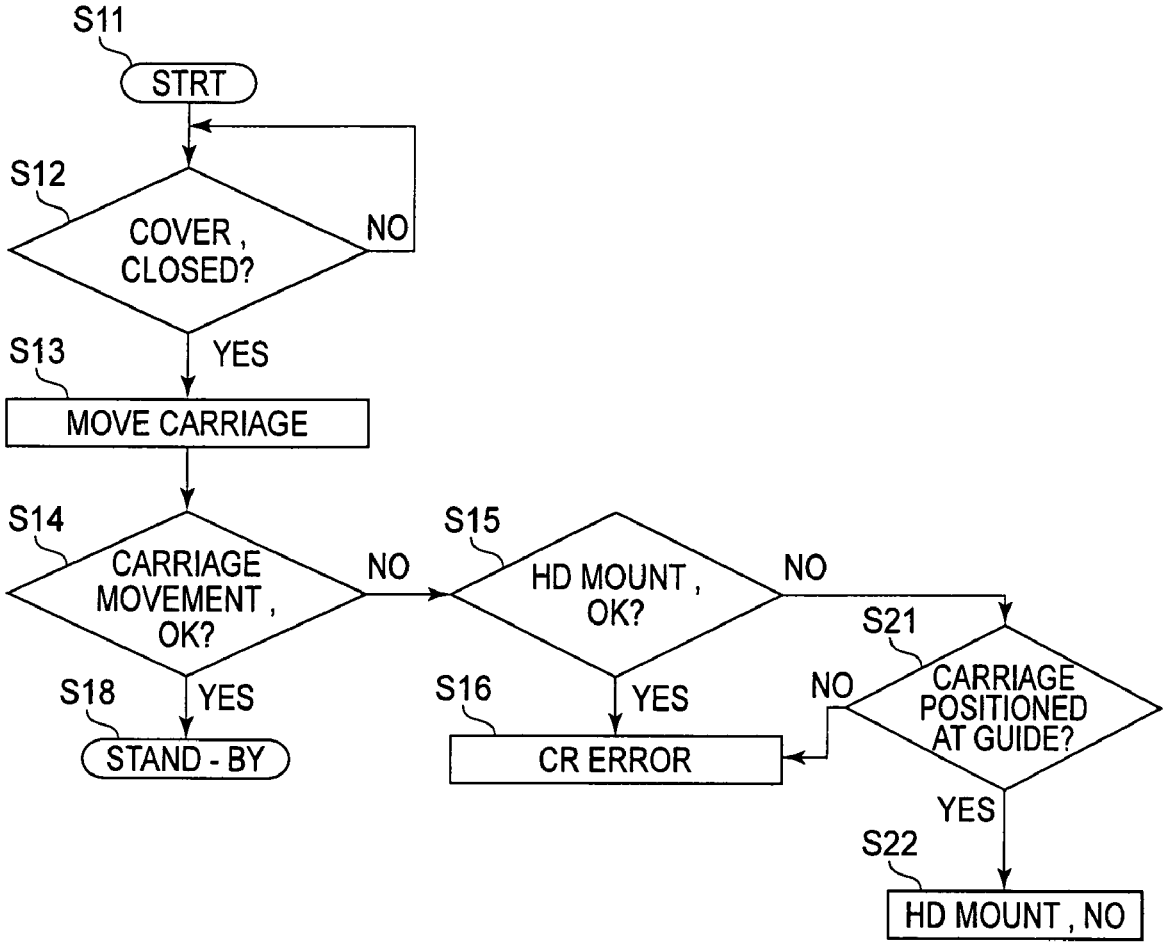
FIG. 14 is a flowchart of the operation of the recording apparatus in the second preferred embodiment of the present invention.

Referring to FIG. 14, the second embodiment of the present invention will be described. FIG. 14 is a flowchart of the operational sequence of the recording apparatus in the second embodiment of the present invention. Step S11 to step S15 are the same as those in the first embodiment, and therefore, the description thereof will be omitted for the sake of simplicity. In this embodiment, it is detected in step S15 whether or not the head cartridge 200 is in the carriage 100. If it is detected that the head cartridge 200 is in the carriage 100 (decision is Y), it is determined that the carriage 200 cannot be moved because of the presence of foreign matters on the carriage track, and a message stating the occurrence of a CR error is issued (S15). If it is determined in step S15 that no head cartridge 200 is in the carriage 100 (decision is N), step S21 is taken, in which it is detected whether or not the carriage 100 is at the same location as the guiding member 13 in terms of the reciprocating direction of the carriage 100. If it is determined in step S21 that the carriage 100 is at the same location as the guiding member 13 (decision is Y), it is determined that the carriage 100 cannot be moved because of the contact between the head cartridge 200 and guiding member 13, and therefore, it is determined that the head cartridge 200 has been incompletely mounted (S22). If it is determined in step S21 that the carriage 100 is not at the same location as the guiding member 13 (decision is No), it is determined that the carriage 100 cannot be moved because of the presence of the foreign matters on the carriage track, and the CR error message is issued (S16).

In other words, if the carriage 100 is not normal in its movement, the position of the carriage 100 is detected to ensure that it is detected that the head cartridge 200 has been incompletely mounted.

Embodiment 3

Figure 15:
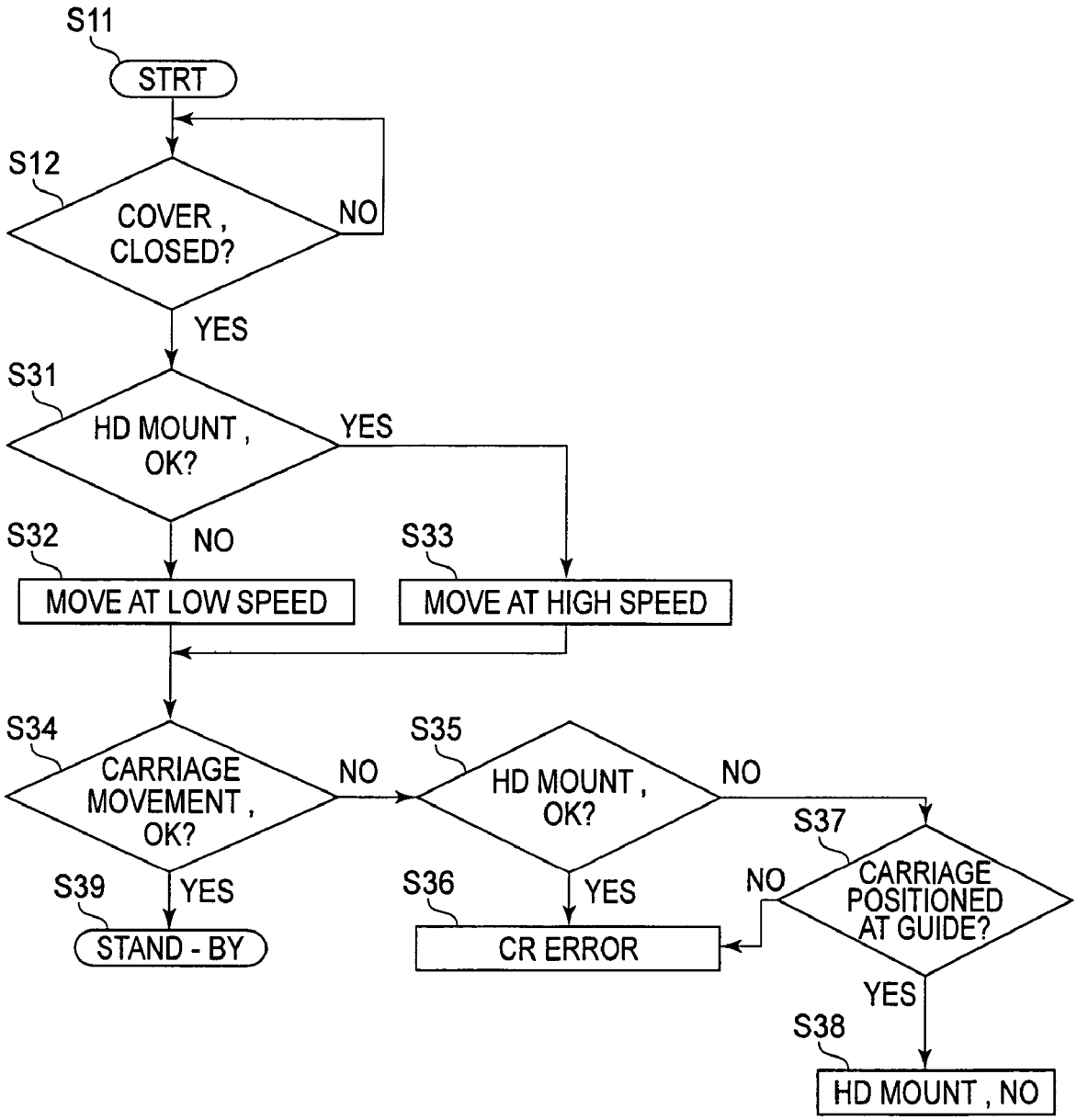
FIG. 15 is a flowchart of the operation of the recording apparatus in the third preferred embodiment of the present invention.

Referring to FIG. 15, the third embodiment of the present invention will be described. FIG. 15 is a flowchart of the operational sequence of the recording apparatus in this embodiment. Step S11 to step S12 are the same as those in the first embodiment, and therefore, the description thereof will be omitted for the sake of simplicity. In this embodiment, before the carriage 100 is moved, it is detected whether or not the head cartridge 200 is in the carriage 100. If it is determined in step S31 that the head cartridge is not in the carriage 100 (decision is N), step S32 is taken, in which the carriage 100 is moved at a low speed. If it is determined in step S31 that the head cartridge 200 is in the carriage 100 (decision is Y), step S33 is taken, in which the carriage 100 is moved at a high speed. Then, in step S34, it is detected, based on the signals from the encoder, whether or not the carriage movement is normal. The operational steps thereafter are the same as those in the second embodiment, and therefore, the description thereof is omitted for simplicity.

In this embodiment, before the carriage is moved, whether or not the head cartridge is in the carriage 100 is detected. Then, if the head cartridge is in the carriage, the carriage 100 is moved at a high speed. Therefore, this embodiment makes it possible to reduce the length of time necessary to ready the recording apparatus.

The maximum size of a sheet of recording medium usable with the recording apparatus in each of the preceding embodiments was LTR. These recording apparatuses were structured so that in terms of the reciprocating direction of the carriage 100, the head guiding member 13 is located as the same location as where the carriage 100 begins to be accelerated when an image is borderlessly formed on a sheet of recording medium of the largest size usable with the recording apparatus. This structural arrangement makes it unnecessary to increase the width of the recording medium.

As will be evident from the description of the preferred embodiments of the present invention given above, the present invention makes it possible to provide an ink jet recording apparatus, which is simple in structure, and from which a head cartridge does not fall when the head cartridge is mounted or removed.

The preceding preferred embodiments of the present invention were described with reference to the recording apparatus structured so that two head cartridges 200 are mounted in the carriage 100. However, the application of the present invention is not affected by the number of the head cartridges 200 mounted in the carriage 100. That is, the present invention is applicable to a recording apparatus structured so that three or more head cartridges 200 are mounted in the carriage 100, as well as a recording apparatus structured so that only a single head cartridge 200 is mounted in the carriage 100.

Further, the present invention is compatible with a head cartridge, the recording head and ink container of which are integral, a head cartridge, the recording head and ink container of which are independent from each other and are individually mountable in the carriage, a head cartridge, the recording head and ink container of which are connected with a tube. The application of the present invention to a recording apparatus employing any of the above described head cartridges yields the same effects as those described above.

Further, the present invention is compatible with an ink jet head structured to eject ink with the utilization of thermal energy, an ink jet recording head employing electromechanical transducers such as piezoelectric elements. The application of the present invention to a recording apparatus employing any of the abovementioned ink jet recording heads yields the same effects as those described above.

The preceding preferred embodiments of the present invention make it possible to provide a recording apparatus capable of detecting the erroneous mounting of a recording head in its carriage, without the need for the provision of a sensor or a complicated system dedicated to the detection of the erroneous mounting.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 194976/2005 filed Jul. 4, 2005 which is hereby incorporated by reference.

What is claimed is:

1. A recording apparatus comprising:

a carriage including a plurality of slots for carrying head cartridges, respectively, said carriage being movable while carrying at least one head cartridge;

a guiding member for guiding a head cartridge during mounting and removal relative to one of the slots and for preventing movement of said carriage by being abutted by the head cartridge when mounting of the head cartridge is incomplete;

an encoder for detecting movement of said carriage;

a detecting portion for detecting an electrical connection between the at least one of the head cartridges and said carriage; and discriminating means for discriminating that the at least one head cartridge is not properly mounted to said carriage when said encoder, after an operation of mounting the at least one head cartridge to said carriage, does not detect the movement of said carriage, and said detecting portion, after said encoder does not detect the movement of said carriage, does not detect electrical connection between said carriage and the at least one head cartridge.

2. The apparatus according to claim 1, further comprising an openable and closable cover member at a position where the at least one head cartridge is mounted to or removed from said carriage, wherein said carriage moves upon closure of said cover member.

3. The apparatus according to claim 1, wherein said detecting portion detects an electrical connection between a wiring board of the at least one head cartridge and a connector of said carriage.

4. The apparatus according to claim 1, wherein when said discriminating means discriminates that the at least one head cartridge is not properly mounted to said carriage, such an event is displayed on a main assembly of the recording apparatus.

5. The apparatus according to claim 1, wherein each head cartridge includes a recording head and an ink container which are integral with each other.

6. The apparatus according to claim 1, wherein a recording head and an ink container of each head cartridge are mountable to said carriage individually.

7. A recording apparatus comprising:

a carriage including a plurality of slots for carrying head cartridges, respectively, said carriage being movable while carrying at least one of the head cartridges;

a guiding member for guiding each of the head cartridges during mounting and removal relative to one of the slots and for preventing movement of said carriage by being abutted by at least one of the head cartridges when mounting of the at least one of the head cartridges is incomplete;

detection means for detecting movement of said carriage;

a detecting portion for detecting an electrical connection between the at least one of the head cartridges and said carriage; and control means for, when said detecting portion does not detect that each of the slots carry one of the head cartridges after an operation of mounting the head cartridges to said carriage, moving said carriage at a speed which is lower than a speed when said detecting portion detects that each of the slots carry the head cartridges after the operation of mounting the head cartridges to said carriage.

8. The apparatus according to claim 7, further comprising an openable and closable cover member at a position where at least one of the head cartridges is mounted to or removed from said carriage, wherein said carriage moves upon closure of said cover member.

9. The apparatus according to claim 7, wherein said detecting portion detects an electrical connection between a wiring board of each of the head cartridges and a connector of said carriage.

10. The apparatus according to claim 7, wherein when said detecting portion detects that at least one of the head cartridges is not properly mounted to said carriage, such an event is displayed on a main assembly of the recording apparatus.

11. The apparatus according to claim 7, wherein each head cartridge includes a recording head and an ink container which are integral with each other.

12. The apparatus according to claim 7, wherein a recording head and an ink container of each head cartridge are mountable to said carriage individually.

* * * * *